United States Patent [19]

Lucas

[11] 4,142,954

[45] Mar. 6, 1979

[54] ELECTROLYTIC CLEANING OF A SHROUDED BLADE ASSEMBLY

[75] Inventor: Joseph G. Lucas, Trumbull, Conn.

[73] Assignee: Avco Corporation, Stratford, Conn.

[21] Appl. No.: 896,558

[22] Filed: Apr. 14, 1978

[51] Int. Cl.[2] ..... C25F 5/00; C25F 7/00

[52] U.S. Cl. ..... 204/146; 204/272

[58] Field of Search ..... 204/146, 260, 272

[56] References Cited

U.S. PATENT DOCUMENTS

| | | | |
|---|---|---|---|
| 3,819,494 | 6/1974 | Fountain | 204/146 |
| 3,958,984 | 5/1976 | Fountain | 204/146 |

*Primary Examiner*—T. M. Tufariello

*Attorney, Agent, or Firm*—Ralph D. Gelling

[57] ABSTRACT

Electrolytic process and apparatus employs the shroud and depending blades as anodes about a multi-cathode device in a bond material solutionizing electrolyte for obtaining proper contour smoothness without structural depletion of the shroud and/or blades.

4 Claims, 2 Drawing Figures

ELECTROLYTIC CLEANING OF A SHROUDED BLADE ASSEMBLY

BACKGROUND

Prior to this invention it was very expensive to manufacture acceptable stator vane assemblies. As one skilled in the art will readily recognize the rejection rate of such was inordinately high. This was because no matter what extent of care and precision was exercised the joining of vanes to a shroud resulted in excess bulk and irregular geometry of braze buildup at most of the shroud-vane joints and along some airfoil surfaces of the vane that happened to be splattered with braze alloy.

It has been attempted to use immersion stripping in a chemical solution; but in order to protect the assembly in areas not having excess braze on it, expensive and time consuming masking was required. Furthermore as the solution and not the operator was in control of the removal, it was quite possible to damage the structural integrity of the assembly being immersed.

Accordingly, it is the primary object of the subject invention to overcome the shortcomings of the prior art systems for obtaining a smooth airfoil contour for a plurality of vanes arranged about a ring. It is a further object of the invention to provide new and improved apparatus employed in a process of fabricating a shrouded vane assembly. Additional objects and advantages of the invention will become apparent from the following detailed description of the invention taken in conjunction with the drawings.

SUMMARY OF THE INVENTION

The subject invention provides a new and improved method for achieving a smooth airfoil contour of a plurality of vanes arranged about a ring. In the subject method a disc is placed within the area of the vanes and spaced inwardly therefrom with extensions from the disc fitting between successive vanes and being electrically insulated from the vanes and the ring. The assembly is clamped together and immersed in a suitable solutionizing electrolyte, and electrical energy is provided to both the disc and the shrouded vanes thereby creating a current flow from the vanes to the disc extensions which operates to remove bulk and irregular geometry of braze buildup at the vane-ring joints and surfaces. The new and improved apparatus employed in applicant's process includes a disc of a smaller diameter than the inner diameter of the vanes, with a plurality of removable extensions secured to the disc and adapted to be located between the vanes, but spaced sufficiently from the shroud and the vanes so as to not be electrically connected therewith.

DRAWING DESCRIPTION

FIG. 1 is a schematic illustration of a shrouded vane assembly with a cathodic disc assembly in an electrolyte and connected to an appropriate electrical source; and FIG. 2 is an end view of the shroud-vane assembly with the disc-extension assembly in place within its profile.

DETAILED DESCRIPTION

Figure 1:
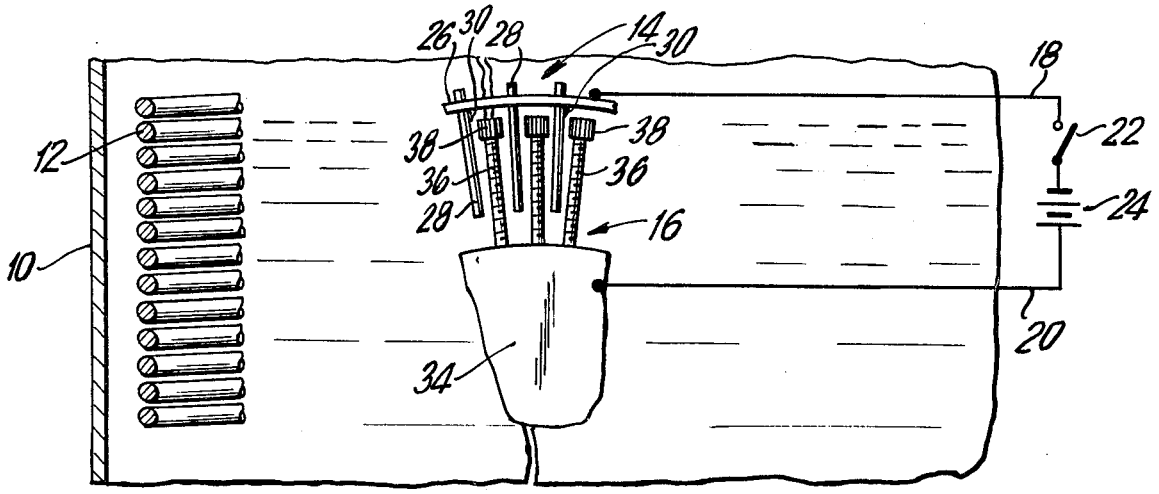

With more particular reference to FIG. 1 a vat 10 is shown having a sodium cyanide solution contained therewithin. The sodium cyanide solution preferably consists of eight ounces of sodium cyanide (NaCN) per gallon of water. Alternatively, any other silver alloy solutionizing electrolyte may be employed. A temperature controlling coil 12 is shown within the vat 10 so as to maintain the solution at optimum operating temperature, i.e., 120° F. ± 20° F.

A stator assembly 14 is shown immersed in the electrolyte with a cathodic assembly 16 within the opening under the vanes and therebetween. There are electrical leads 18 and 20 connecting switch 22 and a DC source 24 exterior of the vat 14 to the stator assembly and the cathodic assembly.

Figure 2:
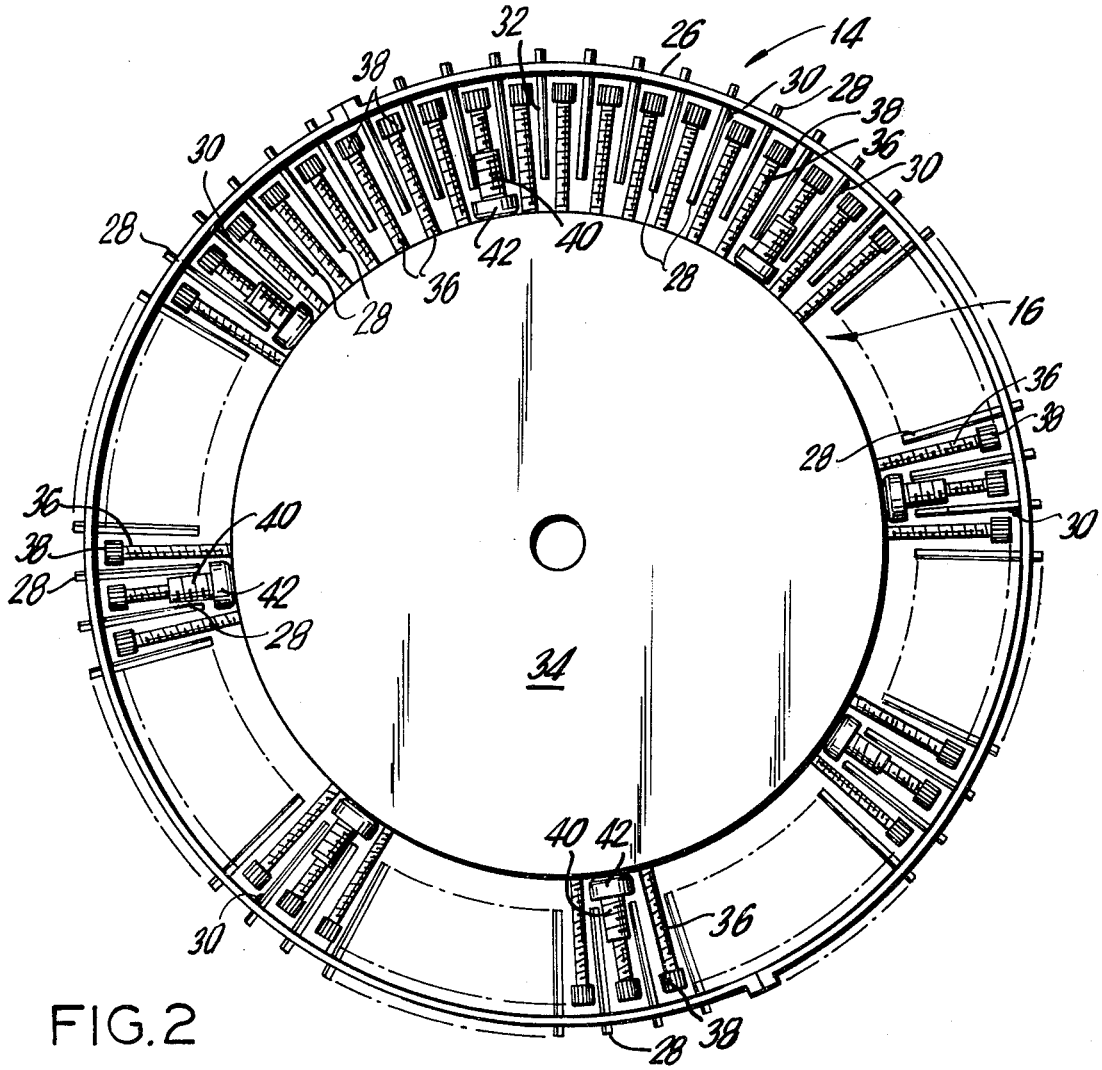

With reference to FIG. 2 the cathodic assembly and stator assembly cooperation are shown in more detail. Specifically the stator assembly has an annular shroud 26 (ring) to which are joined a multiplicity of vanes 28 as by silver brazing. As may be expected such practical technique of joining tends to build up unnecessary bulk, as at 30, in the joint and can provide airflow interrupting splatters on the airfoil contoured surface 32.

A disc 34 is located within the center of assembly 16 and is spaced from the depending tips of vanes or blades 28. This disc 34 is tapped at a number of locations equal to the blades to receive threaded extensions 36 that have caps 38 on their other ends to space same from surfaces 32 and the inner surface of ring 26. At various locations insulators 40 are fitted over extensions 36 to provide spaced separation support with heads 38.

It should be noted that with a silver braze alloy as the bonding means the sodium cyanide solution was chosen so as to provide for solutionizing of it under proper current application which is preferably 9 volts with a current flow of 300 amps, approximately. Different brazing alloys may require, understandably, different solutionizing electrolytes. It should also be realized that the space or gap dimension is chosen to control cell resistance, i.e., each cell being the area between blades with an extension therein. In some instances, it may be desirable to adjust the electrical parameters to accommodate different vane or shroud structures.

The excessive braze material acts as the anode so that large excesses thereof will give a small gap and vice versa thereby automatically providing the cell resistance (current flow with the excess being the anode) and hence metal removal. It will thus be seen once this disclosure is understood that the stripping of braze alloy in this way is a method of equalizing the excess.

After one immersion and current application the part may be inspected. If certain areas need further treatment one need only remove extensions in areas not needing further stripping and reimmersing the assemblies.

It is to be further noted that the insulators 40 have heads 42 so that a clamp about the shroud (not shown) will by friction provide sufficient uniting of the assemblies.

Accordingly, there is provided a new and improved process as well as tooling for the selective removal of excess silver braze alloy from a compressor stator assembly. The tooling is in the form of a fixture which functions as a cathode holder in applicant's process, and consists of a disc of low alloy steel having drilled and tapped holes in the periphery. Threadably connected to the holes are suitable low alloy steel screws or other appropriately shaped forms which fit into the spaces between the vanes of the stator assembly without electrically contacting the vanes or the ring. The screws act as individual cathodes, while the vanes, or more specifically excess braze alloy on the vanes function as the anode. The assembly of the fixture and the stator can be held in place with a large clamp or other suitable device, and the fixture with the stator is immersed in a suitable solution such as a sodium cyanide solution as mentioned above. With appropriate direct current electrically connected, a variable amount of brazed alloy will be removed from the airfoil surfaces depending on the gap between the cathode (screw) and anode (excess braze alloy). Where a large excess of braze alloy is present, a small gap results between the cathode and anode, and where a small braze alloy excess is present, a large gap results between the cathode and anode. The size of the gap automatically controls the cell resistance and the resulting current flow, and hence the extent of metal removal. Stripping of the braze alloy in this way then becomes a method of equalizing the extent of braze alloy on the vane and stator assembly. After inspection of the treated assembly, those vanes or brazed joints still having excess braze alloys remaining can be electrolyzed as individual cells, if necessary, by merely removing screws (cathodes) from the disc where further removal of brazed alloy is not needed. The process is then repeated. Accordingly, utilizing the subject apparatus and process it is possible to salvage vane assemblies which otherwise might be scrapped or too costly to salvage by other techniques.

Although the invention has been described in conjunction with a single embodiment of the subject apparatus and process, it is readily apparent that various modifications and alterations will occur to those skilled in the art and it therefore should be understood that the appended claims are intended to cover all such modifications as fall within the true spirit and scope of the invention.

I claim:

1. A method for removing excess brazing material from the smooth airfoil contour of a plurality of vanes joined by brazing to and arranged about a ring, said method comprising the steps of:

placing a disc within the area of the vanes to be spaced inwardly therefrom;

inserting electrically conductive extensions from the disc to fit between successive vanes without contacting the vanes or vane ring electrically;

connecting electrical energy to the disc and vanes;

creating a current flow from the vanes to the extensions by immersing them in a silver alloy solutionizing electrolyte to remove bulk and irregular geometry of braze buildup at the vane to ring joints and surfaces.

2. The method of claim 1 and further characterized by the step of adjusting the position of each extension to gap the clearance between it and the ring or vane to thereby regulate amount of bulk and braze buildup to be removed.

3. The method of claim 1 and further characterized by the steps of:

inspecting said assembly of disc, extensions, ring and vanes after removal from the solution;

removing the extensions in areas where stripping has been sufficient; and reimmersing said assembly and with an application of further current continue stripping in areas still needing same.

4. The method of stripping braze alloy from a shrouded vane assembly, i.e., a turbine stator vane construction, said method comprising the steps of:

joining a plurality of airfoil contoured blades to an annular shroud;

selecting a solid disc of a diameter to fit within the blades depending from the shroud after being joined therewith;

orienting said disc within the plane of the blades by a plurality of extensions projecting between but not contacting electrically the blades and towards but not contacting electrically the shroud;

connecting electrical leads to the disc and the shroud to provide an open electrical circuit;

immersing said disc, extensions, blades and shroud in a temperature-controlled electrolyte;

connecting a DC source to the leads to cause current to flow by reason of the electrolyte across the space between blades, shroud and extensions, disc; and flowing excess braze alloy from the blades and shroud to the solution to provide smooth contour of blades, shroud and their joints.

* * * * *